United States Patent [19]

Kelly

[11] Patent Number: 4,643,391

[45] Date of Patent: Feb. 17, 1987

[54] FUEL CONTROL VALVE CONSTRUCTION, PARTS THEREFOR AND METHODS OF MAKING THE SAME

[75] Inventor: Samuel T. Kelly, Torrance, Calif.

[73] Assignee: Robertshaw Controls Company, Richmond, Va.

[21] Appl. No.: 723,068

[22] Filed: Apr. 15, 1985

Related U.S. Application Data

[62] Division of Ser. No. 613,462, May 24, 1984, Pat. No. 4,549,571.

[51] Int. Cl.[4] ..... F16K 31/528

[52] U.S. Cl. ..... 251/85; 74/96; 251/258; 251/259; 251/260; 251/263

[58] Field of Search ..... 251/255, 259, 263, 237, 251/238, 260, 85, 258, 303; 74/96; 137/523, 527.4

[56] References Cited

U.S. PATENT DOCUMENTS

| | | | |
|---|---|---|---|
| 256,873 | 4/1882 | Bohren | 251/260 |
| 580,574 | 4/1897 | Fowler | 251/303 X |
| 850,679 | 4/1907 | Smith | 251/260 |
| 1,259,520 | 3/1918 | Jenkins | 251/263 |
| 1,297,184 | 3/1919 | Klopfenstein et al. | 251/263 |
| 1,403,517 | 1/1922 | Miller | 251/303 X |
| 1,494,808 | 5/1924 | Rousseau | 251/261 |
| 2,237,530 | 4/1941 | Olley | 74/96 |
| 2,544,160 | 3/1951 | Hinrichs | 251/261 |
| 2,738,948 | 3/1956 | Barnes | 251/260 |
| 2,846,181 | 8/1958 | Orelind et al. | 251/260 |
| 4,248,403 | 2/1981 | Scull | 251/85 |

*Primary Examiner*—Martin P. Schwadron
*Assistant Examiner*—Stephen M. Hepperle
*Attorney, Agent, or Firm*—Candor, Candor & Tassone

[57] ABSTRACT

A fuel control valve construction, parts therefor and methods of making the same are provided, the construction having a housing provided with an inlet adapted to be interconnected to a fuel source and an outlet adapted to be interconnected to a burner. The housing has a main pressure regulator and a main valve operated by the main pressure regulator for controlling fuel flow from the inlet to the outlet to provide a full rated flow of fuel to the burner. The housing has a by-pass for interconnecting the inlet to the outlet to provide a fuel flow to the burner that is less than a full rated flow of fuel but is sufficient by itself to support combustion at the burner until the main valve provides the full rated flow of fuel thereto. The housing has a by-pass pressure regulator for controlling the flow of fuel through the by-pass independently of the operation of the main pressure regulator.

7 Claims, 19 Drawing Figures

FUEL CONTROL VALVE CONSTRUCTION, PARTS THEREFOR AND METHODS OF MAKING THE SAME

CROSS REFERENCE TO RELATED APPLICATION

This application is a divisional patent application of its copending parent patent application, Ser. No. 613,462, filed May 24, 1984, now U.S. Pat. No. 4,549,571, issued Oct. 29, 1985.

BACKGROUND OF THE INVENTION

1. Field of the Invention

This invention relates to a new fuel control valve construction and to a method of making the same as well as to new parts for such a fuel control valve construction or the like and to methods of making such parts.

2. Prior Art Statement

It is known to provide a fuel control valve construction having a housing means provided with an inlet means adapted to be interconnected to a fuel source and an outlet means adapted to be interconnected to a burner means, the housing means having a main pressure regulator means and a main valve means operated by the main pressure regulator means for controlling fuel flow from the inlet means to the outlet means to provide a full rated flow of fuel to the burner means and having a by-pass means for interconnecting the inlet means to the outlet means to provide a fuel flow to the burner means that is less than a full rated flow of fuel but is sufficient by itself to support combustion at the burner means until the main valve means provides the full rated flow of fuel thereto. For example, see the Fleer U.S. Pat. No. 4,060,370.

It is also known to provide a valve construction having a frame pivotally carrying a lever that has a valve member thereon, the frame having spring means operatively interconnected to the lever to tend to hold the lever in one pivoted position thereof and having an electrical coil means for attracting the lever means to another pivoted condition in opposition to the spring means when the coil means is energized. The spring means is held in its actuating position by being directly interconnected to the housing means that carries the frame means.

It is also known to provide a valve construction having a valve unit comprising a valve seat, a movable valve member for opening and closing the valve seat, a leaf member carrying the valve member and having opposed ends one of which is operatively interconnected to the construction, and a rotatable actuator having cam means operating on the leaf member to position the leaf member relative to the valve seat in relation to the rotatable position of the cam means, the cam means engaging the leaf member intermediate the one end thereof and the valve member.

SUMMARY OF THE INVENTION

It is one feature of this invention to provide a new fuel control valve construction for initially providing soft ignition at a burner means with a flow of fuel that is less than a full rated flow of fuel but is sufficient by itself to support combustion at the burner means until a main valve means of the fuel control valve construction provides a full rated flow of fuel to the burner means.

In particular, it was found according to the teachings of this invention that the by-pass flow of fuel of such a fuel control valve construction can be controlled by a by-pass regulator means independently of the operation of the main pressure regulator means that controls the main valve means of the control device whereby the by-pass flow of fuel is not influenced by the operation of the main pressure regulator means.

For example, one embodiment of this invention provides a fuel control valve construction having a housing means provided with an inlet means adapted to be interconnected to a fuel source and an outlet means adapted to be interconnected to a burner means, the housing means having a main pressure regulator means and a main valve means operated by the main pressure regulator means for controlling fuel flow from the inlet means to the outlet means to provide a full rated flow of fuel to the burner means. The housing means has a by-pass means for interconnecting the inlet means to the outlet means to provide a fuel flow to the burner means that is less than a full rated flow of fuel but is sufficient by itself to support combustion at the burner means until the main valve means provides the full rated flow of fuel thereto. The housing means has a by-pass pressure regulator means for controlling the flow of fuel through the by-pass means independently of the operation of the main pressure regulator means.

It is another feature of this invention to provide new parts for such a control device or the like.

For example, one embodiment of this invention provides a valve construction having a frame pivotally carrying a lever that has a valve member thereon, the frame having spring means operatively interconnected to the lever to tend to hold the lever in one pivoted condition on the frame and having an electrical coil means for attracting the lever to another pivoted condition in opposition to the spring means when the coil means is energized. The frame has an arm provided with a free end that has a first portion thereof engaging the lever to define pivot point means for the lever and a second portion thereof engaging the spring means to define actuating means for the spring means.

Another embodiment of this invention provides a valve construction having a valve unit comprising a valve seat, a movable valve member for opening and closing the valve seat, a leaf member carrying the valve member and having opposed ends one of which is operatively interconnected to the construction, and a rotatable actuator having cam means operating on the leaf member to position the leaf member relative to the valve seat in relation to the rotatable position of the cam means. The other end of the leaf member is looped to define a pair of spaced apart surfaces joined together by an arcuate portion whereby the other end is substantially U-shaped, the cam means having an abutment means received between the surfaces to act on the other end of the leaf member to position the same relative to the valve seat.

Accordingly, it is an object of this invention to provide a new fuel control valve construction having one or more of the novel features of this invention as set forth above or hereinafter shown or described.

Another object of this invention is to provide a new method of making a fuel control valve construction, the method of this invention having one or more of the novel features of this invention as set forth above or hereinafter shown or described.

Another object of this invention is to provide a new part for such a fuel control valve construction or the like, the part of this invention having one or more of the novel features of this invention as set forth above or hereinafter shown or described.

Another object of this invention is to provide a new method of making a new part for a fuel control valve construction or the like, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
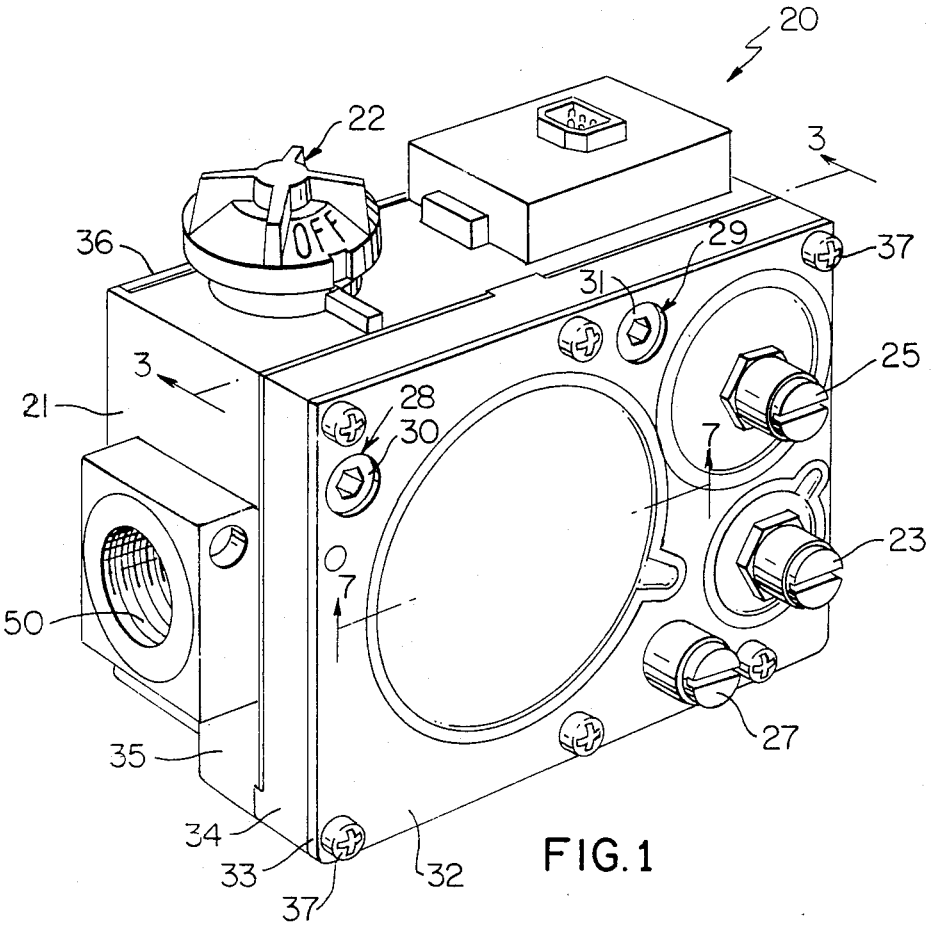
FIG. 1 is a front perspective view of the new fuel control valve construction of this invention.

While the various features of this invention are hereinafter illustrated and described as being particularly adapted to provide a valve construction for controlling a flow of gaseous fuel, such as natural gas, to a main burner means of a heating apparatus, such as a furnace, water heater, etc., it is to be understood that the various features of this invention can be utilized singly or in various combinations thereof to provide a fuel control valve construction for other apparatus and/or other fuels as desired.

Therefore, this invention is not to be limited to only the mebodiments illustrated in the drawings, because the drawings are merely utilized to illustrate one of the wide variety of uses of this invention.

Figure 2:
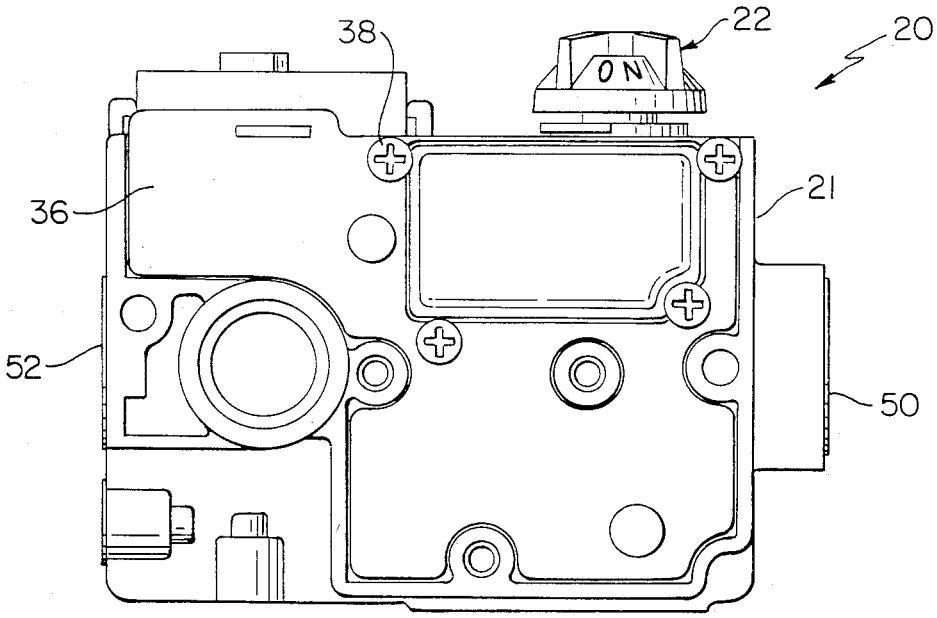
FIG. 2 is a rear view of the fuel control valve construction of FIG. 1.

As illustrated in FIGS. 1 and 2, the improved fuel control valve construction of this invention is generally indicated by the reference numeral 20 and comprises a housing means 21 having a manually operable on-off rotatable selector means or knob 22, access means 23 for adjusting a main pressure regulator means 24 (FIGS. 10 and 19), access means 25 for adjusting a by-pass pressure regulator means 26 (FIGS. 10 and 19), an access means 27 for controlling the rate of fuel flow to a pilot burner means 43 (FIG. 19), and pressure tap access means 28 and 29 for respectively permitting suitable gauge means to be inserted therein after closure means 30 and 31 thereof have been removed in order to check respectively the inlet pressure and the outlet pressure in a manner well known in the art.

When the fuel control valve construction 20 is disposed in the position illustrated in FIG. 1, it can be seen that the on-off control knob means 22 is disposed on the top of the housing means 21 while the access means 23, 25 and 27 and the pressure tap means 28 and 29 are all disposed on one side means 32 of the housing means 20 whereby once the fuel control valve construction 20 has been mounted in the field, the same can be readily serviced from that one side 32 thereof.

While the housing means 21 can be formed in any suitable manner and of any suitable material, it can be seen that the same is formed of a plurality of metallic housing parts 33, 34, 35 and 36 disposed together with suitable sealing gasket means in stacked relation and being secured together by suitable fastening means 37 (FIG. 1) and 38 (FIG. 2), the housing parts 33 and 36 respectively defining front and rear plates depending upon the position of the fuel control valve construction 20.

Figure 19:
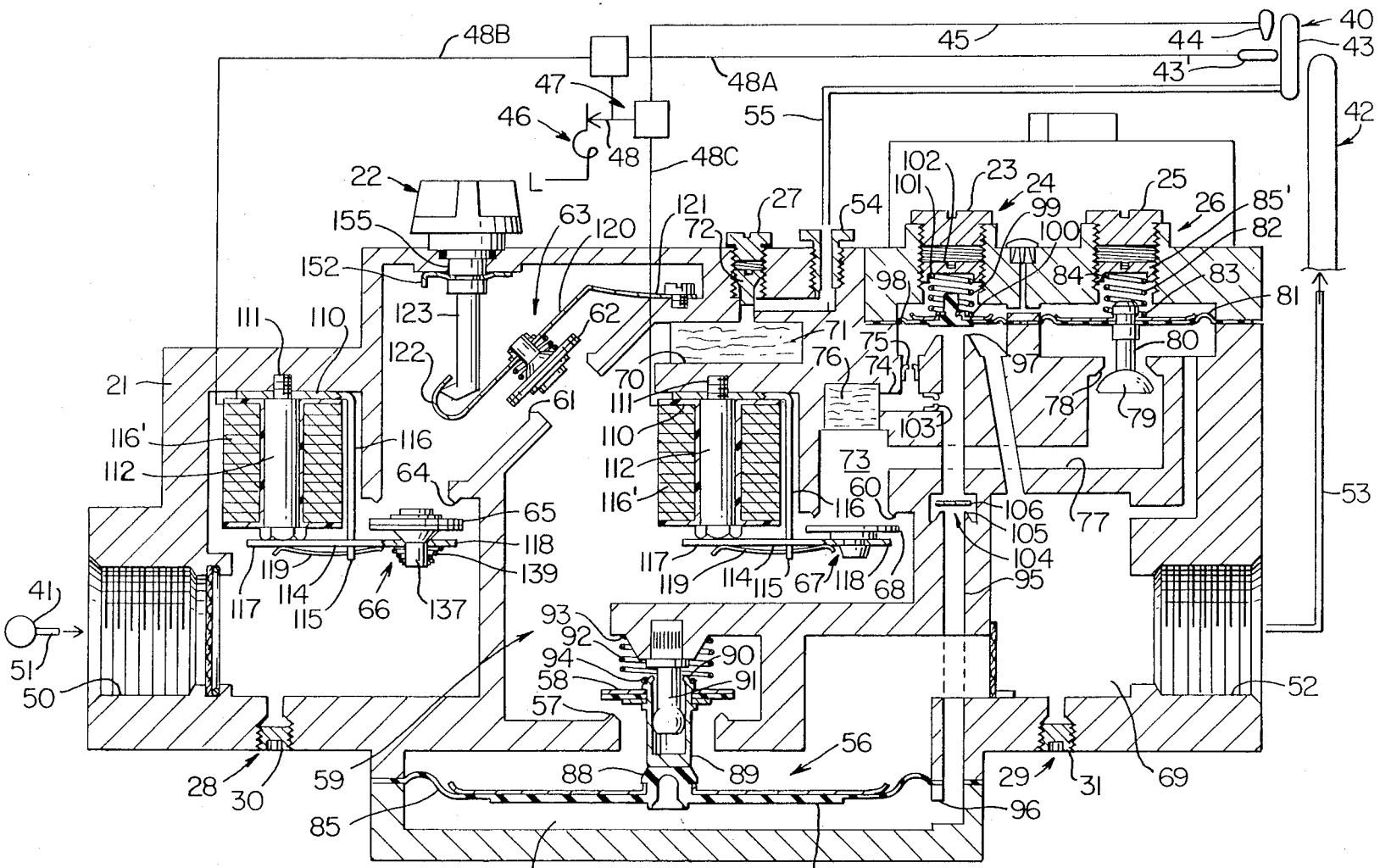
FIG. 19 is an enlarged schematic cross-sectional view of the fuel control valve construction of FIG. 1 and schematically illustrates the same being utilized in a fuel control system.

While the fuel control valve construction 20 of this invention can be utilized in any desired fuel control system to control the operation thereof in any suitable manner, the fuel control valve construction 20 of this invention is schematically illustrated in cross section in FIG. 19 for controlling a fuel control system that is generally indicated by the reference numeral 40 and comprising a source 41 of fuel, such as a pressurized supply of natural gas that is supplied to buildings, houses, etc., by a public utility company, a main burner means 42, such as for a furnace for a building, house, etc., a pilot burner means 43 for igniting the burner means 42 when the fuel is directed thereto in a manner hereinafter set forth, an electrical igniter means 43' for igniting fuel that issues from the pilot burner means 43, a proof of flame means 44 for sending an electrical signal through an electrical line 45 as long as the same senses a flame existing at the pilot burner means 43 in a manner well known in the art, and a room or area thermostat means 46 which is adapted to close a switch means 47 so as to direct an electrical signal through an electrical line 48 when the thermostat means 46 determines that the main burner means 42 should be supplying heat to the area being monitored by the thermostat means 46 and for opening the switch means 47 when the thermostat means 46 determines that the burner means 42 should no longer be supplying heat to the area being monitored by the thermostat means 46 in a manner conventional in the art.

Figure 3:
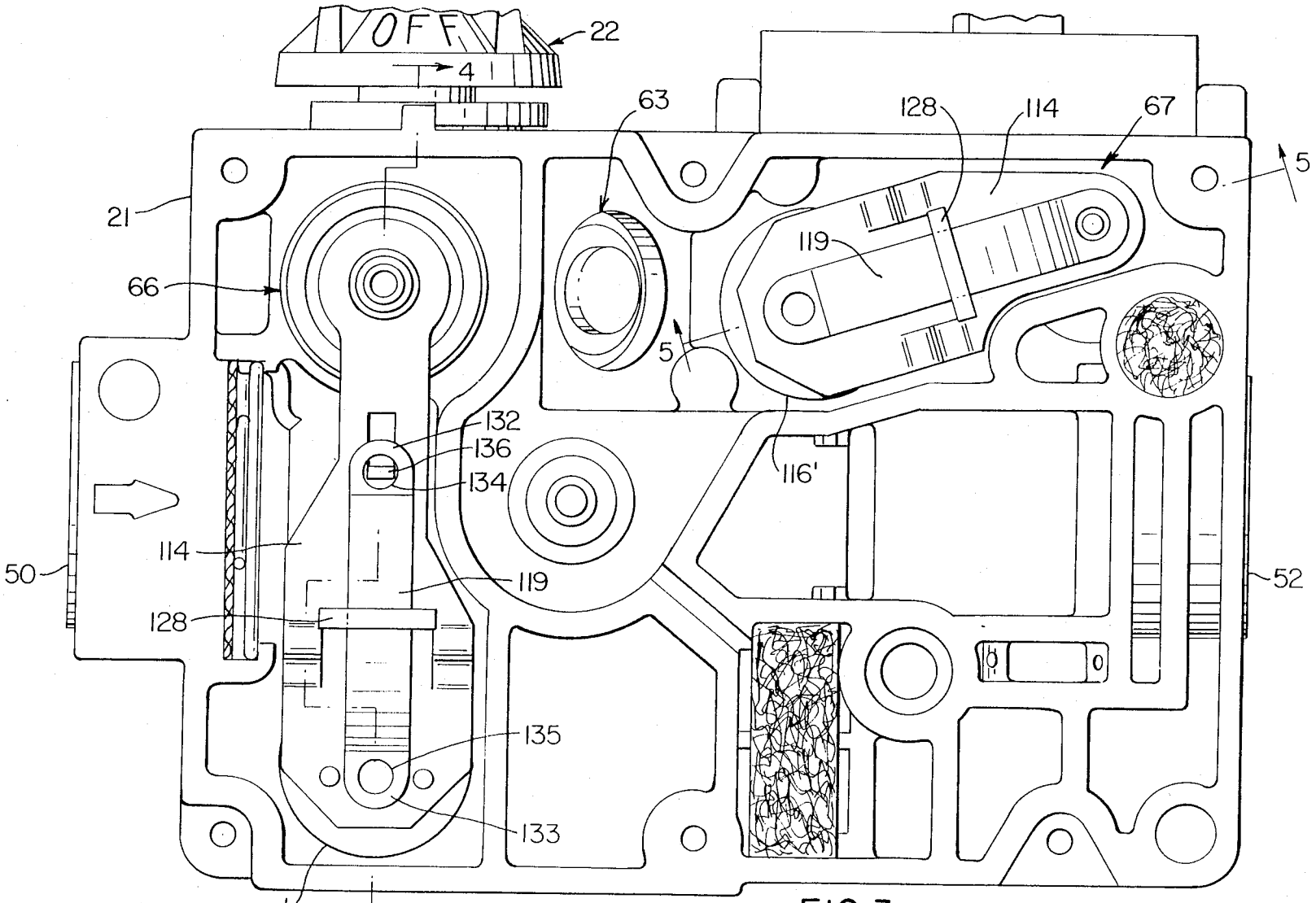
FIG. 3 is an enlarged view of the fuel control valve construction of FIG. 1 with part of the housing means thereof having been removed and is taken in the direction of the line 3—3 of FIG. 1.

As illustrated in FIG. 19, as well as in FIGS. 1–3, the housing means 21 has an inlet 50 adapted to be supplied fuel from the source 41 by a conduit means 51 suitably interconnected to the inlet means 50 in a conventional manner. The housing means 21 has an outlet means 52 adapted to be interconnected to a conduit means 53 in a manner conventional in the art to supply fuel to the main burner means 42 in a manner hereinafter set forth. The housing means 21 also has a pilot outlet means 54 for directing fuel through a conduit means 55 to the pilot burner means 43 in a manner hereinafter set forth.

A main valve means that is generally indicated by the reference numeral 56 in FIG. 19 is disposed in the housing means 21 and comprises a main valve seat 57 and a movable main valve member 58, the valve seat 57 being disposed in a passage means 59 formed in the housing means 21 and leading from the inlet means 50 to the main valve seat 57 as well as to another valve seat 60 for a purpose hereinafter described.

The housing means 21 has a valve seat 61 in the passage means 59 upstream of the parallel arranged valve seats 57 and 60, the valve seat 61 being opened and closed by a movable valve member 62 of a valve unit 63 that is under the control of the manually operable control knob 22 in a manner hereinafter set forth.

In addition, the housing means 21 has a valve seat 64 disposed upstream of the valve seat 61 and being controlled by a movable valve member 65 of a valve unit 66 that is under the control of the thermostat means 46 in a manner hereinafter set forth.

The valve seat 60 of the housing means 21 is controlled by a valve unit 67 that includes a movable valve member 68 for opening and closing the valve seat 60 under the control of the thermostat 46 and the proof of flame means 44 in a manner hereinafter set forth.

The passage means 59 of the housing means 21 leads to the outlet means 52 through the main valve seat 57, the passage means 59 defining an outlet chamber 69 downstream of the valve seat 57 and leading to the outlet means 52.

Figure 11:
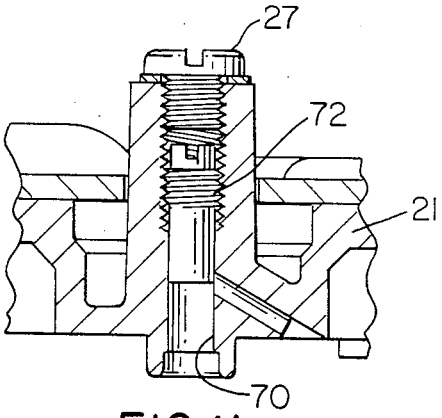
FIG. 11 is an enlarged fragmentary cross-sectional view taken on line 11—11 of FIG. 8 and illustrates the pilot fuel flow adjusting means of the fuel control valve construction of FIG. 1.
Figure 12:
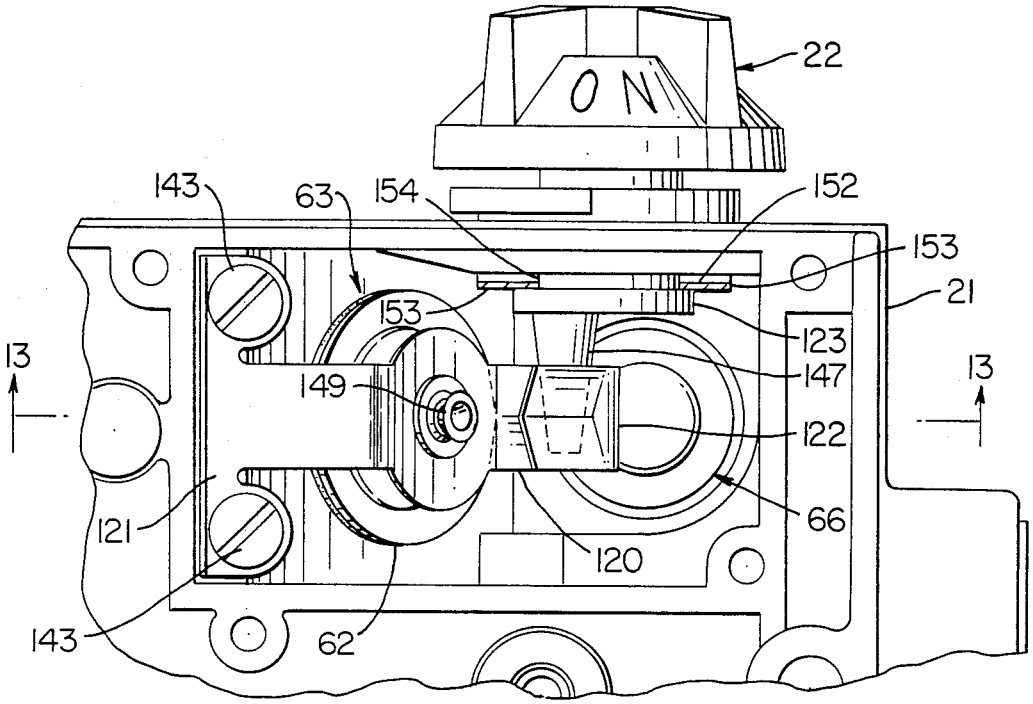
FIG. 12 is a fragmentary view of the fuel control valve construction of FIG. 4 and is taken generally in the direction of the arrows 12—12 thereof, FIG. 12 illustrating the manually operated valve unit of the fuel control valve construction of FIG. 1.

The portion of the passage means 59 of the housing means 21 that is disposed downstream of the valve seat 61 and upstream of the valve seats 57 and 60 is interconnected to a chamber 70 of the housing means 21 that has a suitable filter 71 disposed therein and leading through a flow restricing adjusting key or member 72 (FIGS. 19 and 11) to the pilot outlet means 54 to continuously direct fuel from the source 41 to the pilot burner means 43 through the conduit means 55 as long as the valve units 63 and 66 are disposed in the open condition as illustrated in FIG. 19 even though the valve seats 57 and 60 would be in a closed condition as will be apparent hereinafter.

The passage means 59 downstream of the valve seat 60 defines a chamber 73 that interconnects with one branch 74 of the passage means 59 that leads to the outlet chamber 69 and has a restriction means 75 therein as well as a filter means 76 disposed upstream of the restriction means 75.

Figure 10:
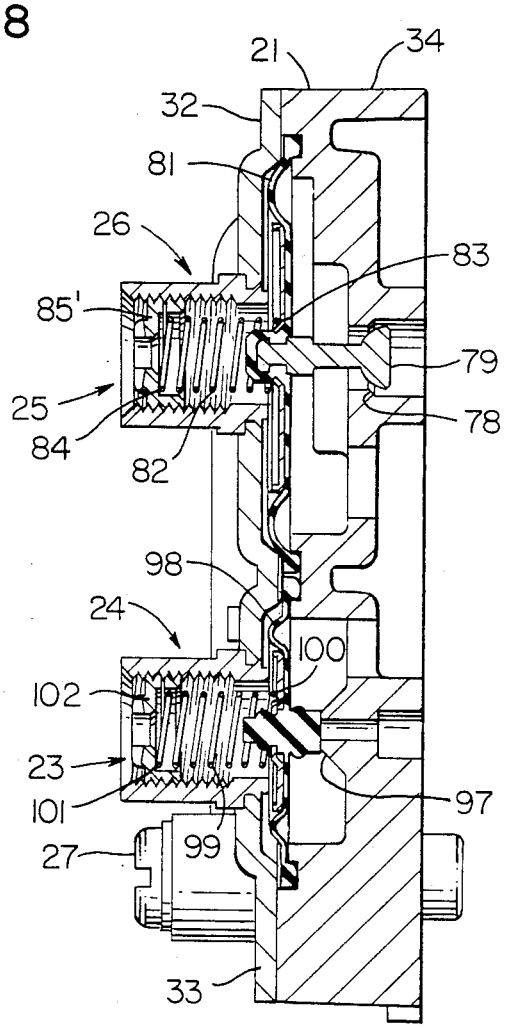
FIG. 10 is an enlarged cross-sectional view taken on line 10—10 of FIG. 8 with certain parts of the fuel control valve construction removed, FIG. 10 illustrating the main pressure regulator means and by-pass regulator means of the fuel control valve construction of FIG. 1.

The chamber 73 of the passage means 59 also interconnects with another branch 77 of the passage means 59 that leads to the oulet chamber 69 through the by-pass pressure regulator means 26 that includes a valve seat 78 in the branch 77 that is opened and closed by a movable valve member 79. The movable valve member 79 is disposed on one side of the valve seat 78 and has a post means 80 extending through the valve seat 78 to the other side thereof and being interconnected to a flexible diaphragm means 81 that is urged in a direction to open the valve seat 78 by a compression spring 82 that has one end 83 bearing against the diaphragm means 81 and another end 84 bearing against an adjustable spring retainer 85' that can be rotated to adjust the force of the compression spring 82 in a manner well known in the art when the access cap 25 is removed as illustrated in FIG. 10.

In this manner, the branch 77 comprises a by-pass passage and the by-pass pressure regulator means 26 is adapted to maintain the pressure of the fuel flow through the branch or by-pass passage 77 to the outlet chamber 69 at a certain pressure value that is less than a pressure value for providing a full rated flow of fuel to the burner means 42 but at a pressure value that is sufficient to support combustion at the burner means 42 until the main valve means 56 supplies a fuel flow to the main burner means 42 at a full rated flow of fuel.

Thus, when the valve units 66, 63 and 67 are disposed in the open condition illustrated in FIG. 19 and the main valve means 56 is disposed in a closed condition thereof, the by-pass flow of fuel through the by-pass passage 77 and the by-pass pressure regulator means 26 is adapted to flow to the main burner means 42 and be ignited by the pilot means 43 so as to create a "soft ignition" of the burner means 42 and maintain a flame at the burner means 42 at a less than a full rated flow of fuel until the main valve means 56 opens to provide the full rated flow of fuel to the burner means 42 in a manner well known in the art and as set forth in the aforementioned U.S. Pat. No. 4,060,370 to Fleer whereby this patent is being incorporated into this disclosure by this reference thereto.

Figure 7:
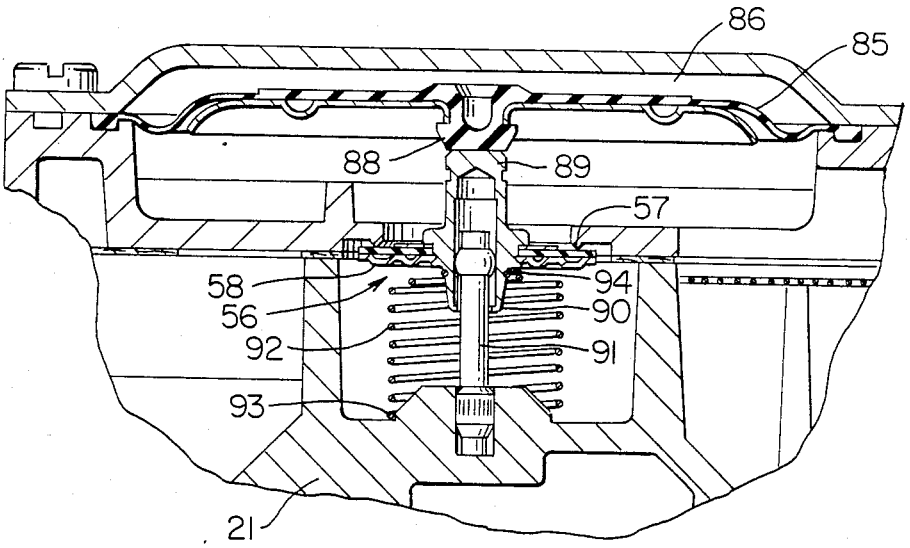
FIG. 7 is a fragmentary enlarged cross-sectional view taken on line 7—7 of FIG. 1 and illustrates the main valve means of the fuel control valve construction of FIG. 1.
Figure 8:
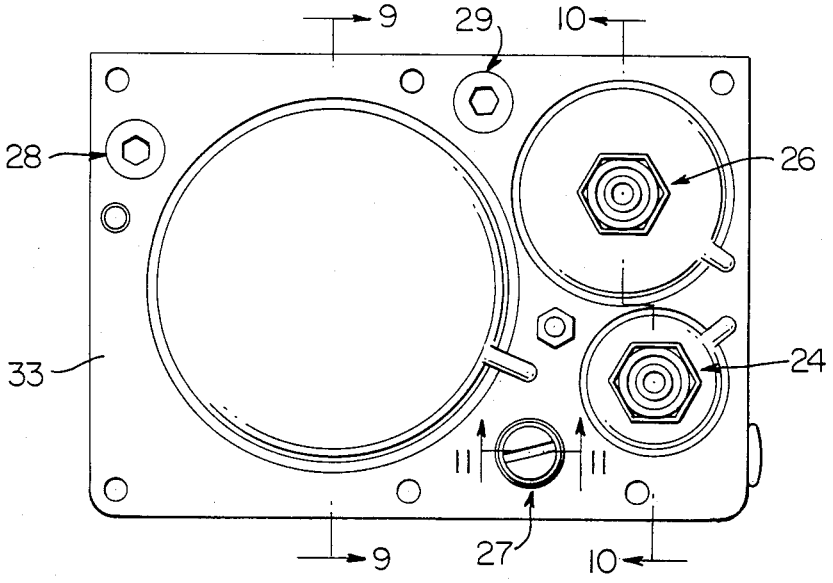
FIG. 8 is a front view of the fuel control valve construction of FIG. 1.

The main valve means 56 as illustrated in FIGS. 19 and 7 comprises a flexible diaphragm means 85 that cooperates with the housing means 21 to define a chamber 86 therewith on one side 87 of the diaphragm means 85, the diaphragm means 85 having the other side 88 thereof being adapted to abut a closed tubular portion 89 of the valve member 58 that projects through the valve seat 57 and has an open end 90 thereof receiving a stationary valve member guide 91 secured to the housing means 21 as illustrated in FIGS. 7 and 19.

The main valve member 58 is urged toward the valve seat 57 by a compression spring 92 having one end 93 bearing against the housing means 21 and the other end 94 bearing against the valve member 58 so that the spring 90 tends to maintain the valve member 58 in a closed condition against the valve seat 57. In this manner, the main diaphragm means 85 is not secured to the valve member 58 but is operatively interconnected thereto to operate the same in a manner hereinafter set forth.

The housing means 21 has a passage 95 formed therein and interconnecting to the chamber 86 at one end 96 thereof and defining a bleed point means 97 at the other end thereof that is adapted to be interconnected to the branch 74 of the passage means 59 downstream of the restrictor means 75, the bleed point means 97 defining a valve seat that is adapted to be controlled by a flexible diaphragm means 98 of the main pressure regulator means 24 in a manner well known in the art.

In particular, the main pressure regulator means 24 has the diaphragm means 98 thereof as illustrated in FIGS. 19 and 10 urged towards the valve seat 97 by a compression spring 99 having one end 100 bearing against the diaphragm 98 and the other end 101 thereof bearing against a rotatable adjustable spring retainer 102 adapted to be adjusted when the access member 23 is removed as illustrated in FIG. 10.

The branch 74 of the passage means 59 of the housing means 21 is interconnected to the passage 95 through a restriction means 103 that is disposed upstream of the restriction means 75, the restriction means 103 being larger than the restriction means 75 and, in one working embodiment of the fuel control valve construction 20 of this invention has an orifice diameter size of approximately 0.031 of an inch while the size of the diameter of the orifice 75 is approximately 0.020 of an inch.

In this manner when the valve units 66, 63 and 67 are all in open condition as illustrated in FIG. 19, the pressure of the fuel being directed through the orifice 103 into the passage 95 and thus being directed to the chamber 86 of the main valve means 56 will be controlled by the main pressure regulator means 24 through the control of the bleed point or valve seat 97 by the diaphragm means 98 in a manner well known in the art so the pressure value being created in the chamber 86 on the side 87 of the diaphragm 85 will cause the diaphragm 85 to eventually move upwardly in FIG. 19 and carry the valve member 58 therewith in opposition to the force of the compression spring 92 to open the valve seat 57 and permit fuel to flow from the passage means 59 upstream of the valve seat 57 through the valve seat 57 and to the outlet chamber 69 that leads to the outlet means 52 that is connected to the main burner means 42. Thus, the main pressure regulator means 24 is adapted to maintain the fuel being directed out of the outlet means 52 to the main burner means 42 at a certain pressure value so as to provide a full rated flow of fuel to the burner means 42 as determined by the position of the valve member 58 relative to the valve seat 57 in relation to the adjusted setting of the main pressure regulator spring 99 in a manner well known in the art.

However, the passage 95 has a one-way delay valve means 104 disposed therein for delaying the pressurizing of the chamber 86 of the main valve means 56 each time the valve unit 67 is initially opened in order to insure that the branch 77 and by-pass pressure regulator means 26 creates a soft ignition at the main burner means 42 before the main valve means 56 opens to supply a full rated flow of fuel to the burner means 42, the one-way delay valve means 104 comprising a valve seat 105 and a valve member 106 which when disposed against the valve seat 105 only permits a slow rate of flow of fuel to pass between the valve member 106 and valve seat 105 to pressurize the chamber 86 in a manner well known in the art, such as in the manner set forth in the U.S. Pat. No. 4,060,370 to Fleer which has already been incorporated in this disclosure by the previous reference thereto.

However, when the valve unit 67 closes the valve seat 60 in a manner hereinafter set forth, the valve member 106 moves off of the valve seat 105 to permit a rapid depressurization of the chamber 86 so that the main valve means 56 can close under the force of the compression spring 92 at a relatively rapid rate when the thermostat means 46 causes the valve unit 67 to close by opening the switch 47.

In particular, when the valve unit 67 closes the valve seat 60, the pressure in the chamber 86 of the main valve means 56 first passes from the passage 95 through the main pressure regulator means 27 from the bleed port means 97 to the outlet means 52 until the spring 99 closes the diaphragm 98 against the valve seat 97 whereby the remaining pressure in the chamber 86 bleeds through the orifice 103, filter 76, branch 77 and the by-pass regulator means 26 to the outlet 52. However, if the by-pass pressure regulator means 26 is not utilized or has the valve member 79 thereof closing the valve seat 78 through a malfunction of the pressure regulator means 26, the remaining pressure in the chamber 86 that passes out through the orifice 103 can pass through the orifice 75 and thus through the branch 74 to the outlet 52 to permit the chamber 86 to be completely depressurized and permit the spring 92 to close its main valve member 58 against the main valve seat 57.

Figure 5:
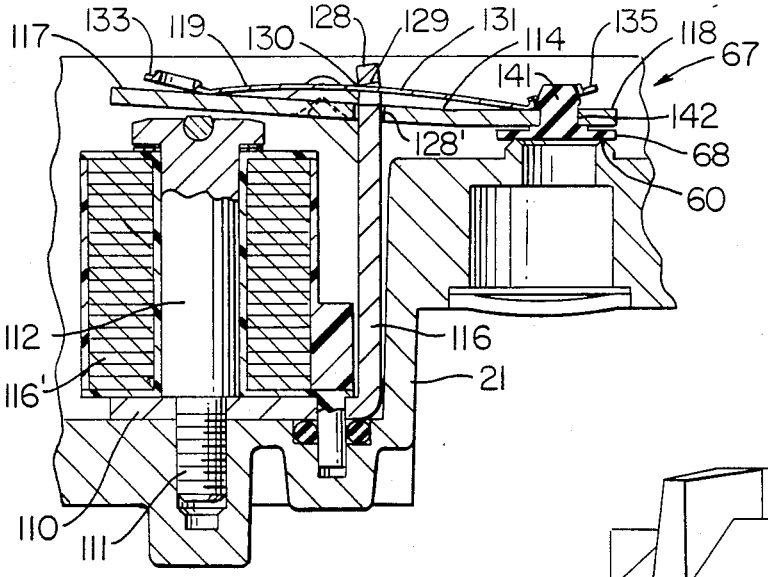
FIG. 5 is a fragmentary cross-sectional view taken on line 5—5 of FIG. 3.
Figure 4:
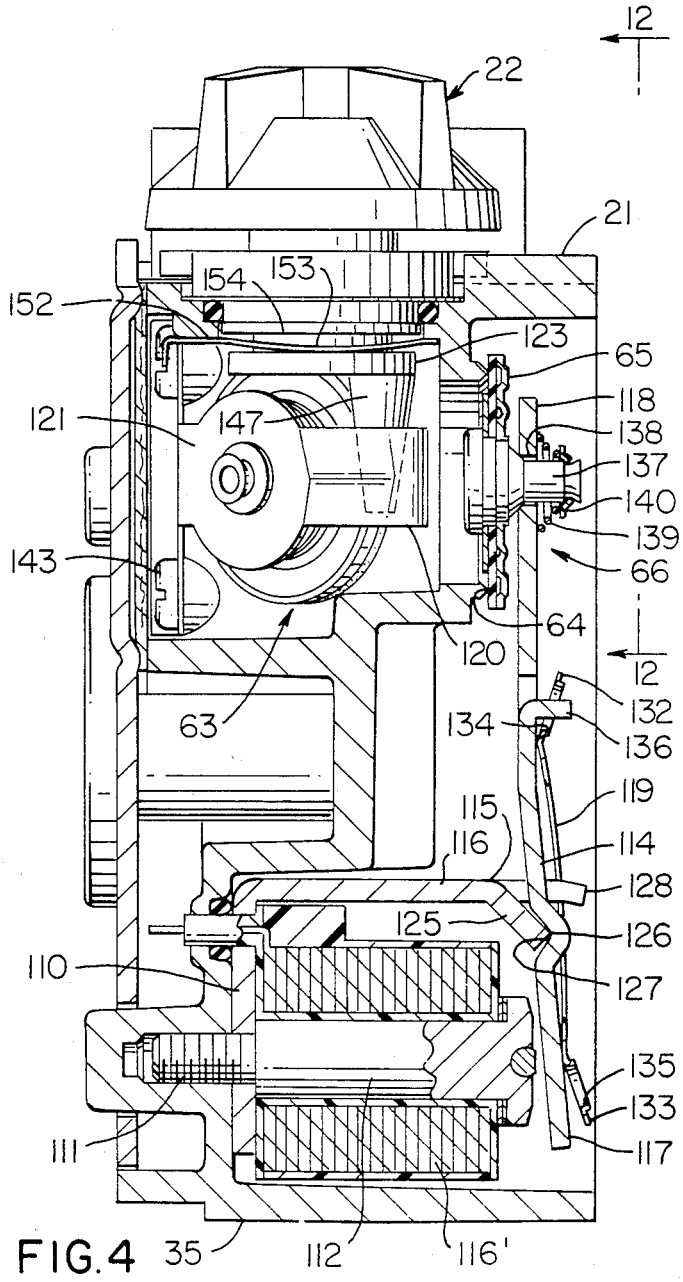
FIG. 4 is a cross-sectional view taken on line 4—4 of FIG. 3.

As illustrated in FIG. 19, as well as in FIGS. 4 and 5, each valve unit 66 and 67 includes a frame 110 secured to the housing means 21 by a threaded fastening member 111 that forms a pole piece 112 for an electrical coil 116' that is also secured to the frame means 110 by the fastening means 111. The frame 110 of each valve unit 66 and 67 pivotally carries a lever 114 on a free end 115 of an arm 116 thereof, the lever 114 having opposed ends 117 and 118 with the end 118 carrying the valve member 65 or 68.

Each valve unit 66 and 67 also includes a leaf spring 119 operatively interconnected to the free end 115 of its respective arm 116 and cooperating with its respective lever 114 in a manner hereinafter set forth to tend to continuously urge its respective lever 114 in a valve seat closing direction. However, when the coil 113 of the valve unit 66 or 67 is energized, the end 117 of the respective lever 114 is attracted toward the core 112 of the coil 116' in opposition to the force of the spring 119 to move its valve member 65 or 68 to its open condition and hold the same in its open condition as long as that coil 113 is energized.

The valve unit 63 as illustrated in FIG. 19, as well as in FIGS. 4 and 12–15, includes a leaf member 120 having one end 121 secured to the housing means 21 and the other end 122 being interconnected to a rotatable cam means 123 that is under control of the control knob 22 whereby rotation of the cam means 123 by the knob 22 to an open position causes the cam means 123 to hold the valve member 62 that is carried by the leaf member 120 in an open position relative to the valve seat 61. When the cam means 123 is rotated by the knob 22 to a closed condition, the cam means 123 as well as natural bias of the leaf member 120 moves the valve member 62 to a closed condition against the valve seat 61.

The particular details of the valve units 63, 66 and 67 will be hereinafter set forth but it is believed that sufficient details of the fuel control valve construction 20 have now been set forth to fully understand the fuel control valve construction 20 whereby the operation of the fuel control valve construction 20 in the fuel system 40 will now be described.

When it is desired to utilize the control device 20 in the fuel control system 40 to tend to maintain an output temperature effect that has been set for the thermostat construction 46 in a conventional manner, the thermostat means 46 is placed in an "on" condition thereof and the control knob 22 is disposed in the "on" position thereof as illustrated in FIG. 19 to hold the valve member 62 away from the valve seat 61. Because at this time the thermostat 46 is demanding heat, the switch means 47 is in its closed condition as illustrated in FIG. 19 whereby the igniter electrode means 43' and the coil 113 of the valve unit 66 are energized through electrical lines 48A and 48B respectively in a manner well known in the art to cause the coil means 116' of the valve unit 66 to open the valve member 65 thereof away from the valve seat 64 and permit fuel to flow through the open valve seats 64 and 61 to the pilot passage 70 and issue from the pilot burner 43 to be ignited by the energized electrical ignition means 43' so that once the pilot burner means 43 is ignited and is continuously burning, the proof of flame sensor 44 in combination with the closed thermostat means 46 sends an electrical signal through electrical line 48C to the coil means 116' of the valve unit 67 to energize the same whereby the valve unit 67 opens and remains in the open condition as long as a flame exists at the pilot burner means 43.

When the valve member 68 of the valve unit 67 first opens relative to the valve seat 60, fuel is adapted to be directed from the passage 59 into the branches 74 and 77 which respectively lead to the outlet chamber means 69. However, the flow of fuel through the orifice 75 of the branch 74 is insufficient to support combustion at the burner means 42 and the flow of fuel through the orifice 103 of the branch 74 is under the control of the main pressure regulator means 24 as well as the delay valve means 104 so that the flow of fuel through the orifice 103 slowly begins to pressurize the chamber 86 of the main valve means 56 which has the valve member 58 thereof being held in the closed position against the valve seat 57 by the force of the compression spring 92. During the time that the chamber 86 is being slowly pressurized by the delay valve means 104 after the valve unit 67 has been opened, the flow of fuel through the branch 77 is being controlled by the by-pass pressure regulator means 26 in such a manner that when the fuel issues through the valve seat 78 to the output chamber 69 and, thus, to the main burner means 42, the fuel issuing from the burner means 42 is at a pressure value that is sufficient to support combustion at the main burner means 42 but at a rate lower than a full rated flow of fuel so that ignition can now occur at the burner means 42 through the continuously burning pilot means 43 whereby a "soft ignition" is provided for the burner means 42 and the burner means 42 continues to operate with the partially rated flow of fuel being supplied thereto by the by-pass passage means 77.

It can be seen that this by-pass flow of fuel to the main burner means 42 is solely under the control of the by-pass pressure regulator means 26 and is not influenced by the operation of the main pressure regulator means 24.

Subsequently, the pressure in the chamber 86 builds sufficiently so that the diaphragm 86 is moved upwardly in FIG. 19 to carry the valve member 58 therewith in opposition to the force of the compression spring 92 to open the valve seat 57 and permit fuel to flow through the valve seat 57 and, thus, through the output chamber 69 to the main burner means 42 at a full rated flow to produce the normal burning rate at the burner means 42 for heating up the area being sensed by the thermostat means 46, the main pressure regulator means 24 maintaining the pressure value of the fuel being permitted to pass through the main valve seat 57 at a certain pressure value that provides for the normal operation of the burner means 42 in relation to the setting of the spring 99 of the main pressure regulator means in a manner well known in the art.

The main valve means 56 continues to supply a full rated flow of fuel to the burner means 42 in the above manner as long as the thermostat means 46 remains in its closed condition as illustrated in FIG. 19. However, when the thermostat means 46 determines that the area being monitored thereby has been sufficiently heated to the set point temperature thereof, the thermostat means 46 opens the switch 47 and thereby causes the coils 113 of the valve units 66 and 67 to be de-energized. The de-energized coils 116' permit the spring means 119 to pivot the levers 114 of the valve units 66 and 67 to their closed condition whereby the valve members 68 are moved against the valve seats 64 and 60 to prevent fuel flow through the passage means 59 and, thus, to the pilot burner means 43 and main burner means 42. The opened thermostat means also prevents any sparking of the igniter means 43'.

The closing of the valve unit 67 causes the pressure in the chamber 86 of the main valve means 56 to open the delayed valve means 104 and rapidly vent through the bleed orifice 97 to the outlet chamber 69 until the diaphragm 98 of the main pressure regulator means 24 closes against the seat 97 under the force of the spring 99 thereof. However, the pressure in the chamber 86 continues to bleed down by passing through the orifice 103 and through the by-pass passage 77 and open valve member 79 of the by-pass pressure regulator means 26 to the chamber 69. If for some reason the valve seat 79 of the by-pass regulator 26 is closed, the bleed through the orifice 103 will bleed through the orifice 75 to the chamber 69 so that the now depressurized chamber 86 permits the compression spring 92 to close the main valve member 58 against the main valve seat 57.

In this manner, the main valve means 56 and the valve units 66 and 67 remain closed as long as the thermostat means 46 is satisfied and is therefore maintaining the switch means 47 opened whereby neither the pilot burner means 43 nor the main burner means 42 can operate.

When the thermostat means 46 again determines that the burner means 42 should heat up the area being monitored by the thermostat means 46, the thermostat means 46 again closes the switch means 47 and causes the valve unit 66 to again open in the manner previously described so that the pilot burner means 43 can be ignited by the igniter means 43' and cause the valve unit 67 to open whereby the by-pass passage 77 again provides a "soft-ignition" of the burner means 42 during the time that the delay means 104 delays the opening of the main valve means 56 to provide for a full rated flow of fuel to the burner means 42 as previously set forth.

Thus, the system 40 continues to operate in the manner previously disclosed. However, should it be desired to completely turn off the system 40 for service reasons or other reasons, the manual valve 22 can be disposed in its closed condition to close the valve member 62 thereof against the valve seat 61 and thereby assure that the flow of fuel not only to the main valve seat 57 but also to the pilot burner 43 will be terminated.

Thus, it can be seen that the fuel control valve construction 20 of this invention will operate in the manner previously described to control the system 40 as previously described.

While it is believed that it is obvious how the various passages illustrated schematically in FIG. 19 can be provided in the housing means 21 so that the same need not be specifically described other details of the valve units 63, 66 and 67, valve means 56 and the regulator means 24 and 26 of the fuel control valve construction 20 of this invention will now be described.

Figure 9:
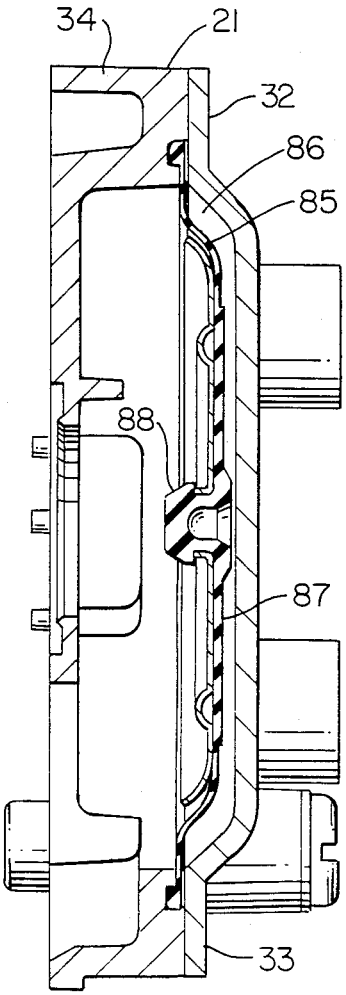
FIG. 9 is an enlarged cross-sectional view taken on line 9—9 of FIG. 8 with certain parts of the fuel control valve construction removed, FIG. 9 illustrating the main diaphragm means of the fuel control valve construction of FIG. 1.

As illustrated in FIGS. 10 and 19, the diaphragms 81 and 98 for the by-pass regulator means 26 and the main pressure regulator means 27 are disposed in side-by-side coplanar relation between the housing parts 33 and 34 and the main diaphragm 85 for the main valve means 56 is likewise disposed between the housing parts 33 and 34 so as to be coplanar with the diaphragms 81 and 98 as illustrated in FIGS. 7 and 9.

Figure 17:
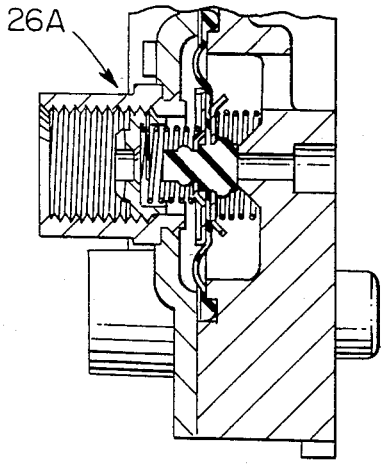
FIG. 17 is a view similar to FIG. 16 and illustrates another embodiment of the main pressure regulator means.

While the fuel control valve construction 20 of this invention has been described as having the main pressure regulator means 24 being provided for operating with a positive pressure of the fuel from the source 41, it is to be understood that the same could be reconstructed to provide for negative pressure operation wherein a blower downstream of the fuel control valve construction 20 pulls the fuel to the burner means 42 in a manner well known in the art and such a pressure regulator means is generally indicated by the reference numeral 26A in FIG. 17 and is conventional in the art so that additional description thereof need not be set forth.

Figure 16:
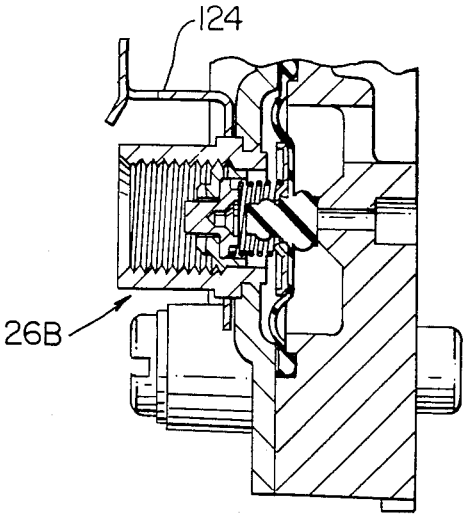
FIG. 16 is a fragmentary view similar to FIG. 10 and illustrates another embodiment of the main pressure regulator means.

Similarly, the main pressure regulator means 24 could be provided with an external lever to adjust the same in a manner well known in the art. For example, such a lever is indicated by the reference numeral 124 in FIG. 16 and such modified pressure regulator is generally indicated by the reference numeral 26B. Since such externally adjusted pressure regulator means are well known in the art, a further description of the pressure regulator 26B of FIG. 16 will not be set forth.

Figure 18:
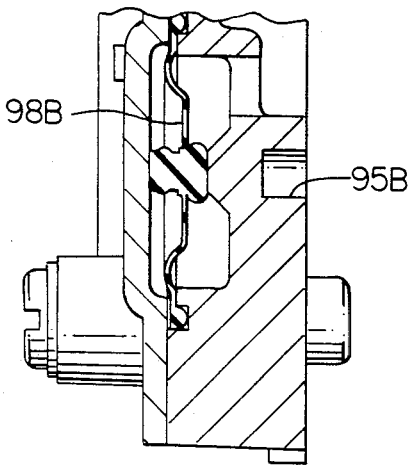
FIG. 18 is a view similar to FIG. 17 and illustrates the fuel control valve construction of this invention when the same does not utilize a main pressure regulator means.

Of course, it is to be understood that the fuel control valve construction 20 of this invention can be utilized without a main pressure regulator means 24 so that a sealing diaphragm means will be utilized therefor. For example, see FIG. 18 wherein a non-operating diaphragm 98B is utilized and the passage 95B does not interrupt the housing means to provide the bleed point means 97 previously described so that the passage 95B is merely supplied by the orifice 103 in the manner previously described.

It is to be understood that such modifications for the main pressure regulator means 24 could also be provided for the by-pass regulator means 26 in the same manner, if desired.

Figure 6:
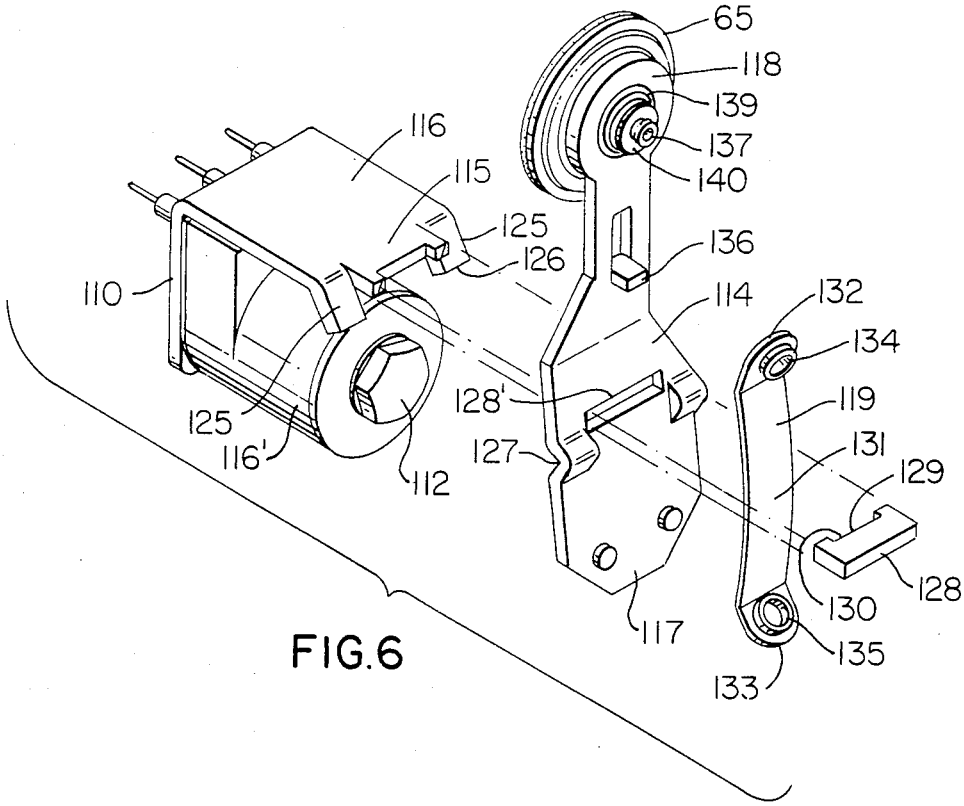
FIG. 6 is an exploded perspective view illustrating certain parts of the valve unit of fuel control valve construction of FIG. 4.

Reference is now made to FIGS. 4 and 6 wherein the valve unit 66 is shown in detail and it can be seen that the free end 115 of the arm 116 of the L-shaped frame 110 has a pair of spaced apart tangs 125 respectively bent therefrom to define edge means 126 which are adapted to be received in notches 127 formed in the lever 114 intermediate the ends 118 and 117 thereof to provide pivot point means for the lever 114 on the frame 110.

The free end 115 of the arm 116 of the frame 110 has a portion 128 adapted to project through an opening 128' formed through the lever 114 and is provided with a slot 129 therethrough through which the leaf spring 119 is received, the slot 129 defining an edge means 130 which bears against a bowed medial portion 131 of the leaf spring 119 that has opposed ends 132 and 133 respectively bearing against the lever 114.

In particular, the leaf spring 119 has openings 134 and 135 respectively passing through the ends 132 and 133 thereof, the opening 134 receiving an upwardly bent tang 136 carved from the lever 114 so as to anchor the end 132 of the leaf spring 119 thereto while the other opening 135 is not utilized whereby either end 132 and 133 of the leaf spring 119 can be hooked onto the tang 136.

In any event, it can readily be seen in FIGS. 4 and 5 that the bowed portion 131 of the spring 119 engages the edge 130 of the portion 128 of the arm 116 in offset relation to the edges 126 of the portion 125 of the arm 116 so as to provide a spring force continuously acting to move its respective valve member 65 toward its valve seat 64 whereby the energized coil 113 overcomes the force of the leaf spring 119 to move the valve member 65 to its open condition relative to the valve seat 64.

The valve member 65 for the valve unit 66 is adapted to self-align against the valve seat 64 as the same has a stem portion 137 passing through an opening 138 in the end 118 of the lever 114 and is provided with a compression spring 139 between the lever 114 and a spring retainer 140 carried on the stem 137 whereby the valve member 65 is adapted to move relative to the lever 114 so as to fully seat against the valve seat 64 in a manner well known in the art for such valve members.

In contrast, the valve member 68 for the valve unit 67 comprises a resilient valve member that has an integral valve stem 141 thereof as illustrated in FIG. 5 press-fitted through an opening 142 in the end 118 of its lever 114 and has the opening 134 of the spring 119 receiving the stem 141 in the manner illustrated in FIG. 5 to hook the spring 119 to the lever 114.

Therefore, it can be seen that the valve units 66 and 67 are substantially the same except that the lever 114 for the unit 66 is longer and carries a movable valve member 65 whereas the lever 114 for the valve unit 67 is shorter and has a resilient valve member 68 formed of any suitable resilient material to permit the valve member 68 to fully seat against the valve seat 60.

Therefore, it can be seen that the valve units 66 and 67 are unique and can be utilized in other valve constructions other than the fuel control valve construction 20 of this invention, if desired.

Reference is now made to FIGS. 12–15 wherein the valve unit 63 is illustrated in detail and it can be seen that the leaf member 120 thereof is adapted to have the end 121 thereof fastened to the housing means 21 by a pair of threaded fastening members 143 passing through suitable openings 144 in the end 121 of the leaf member 120.

Figure 15:
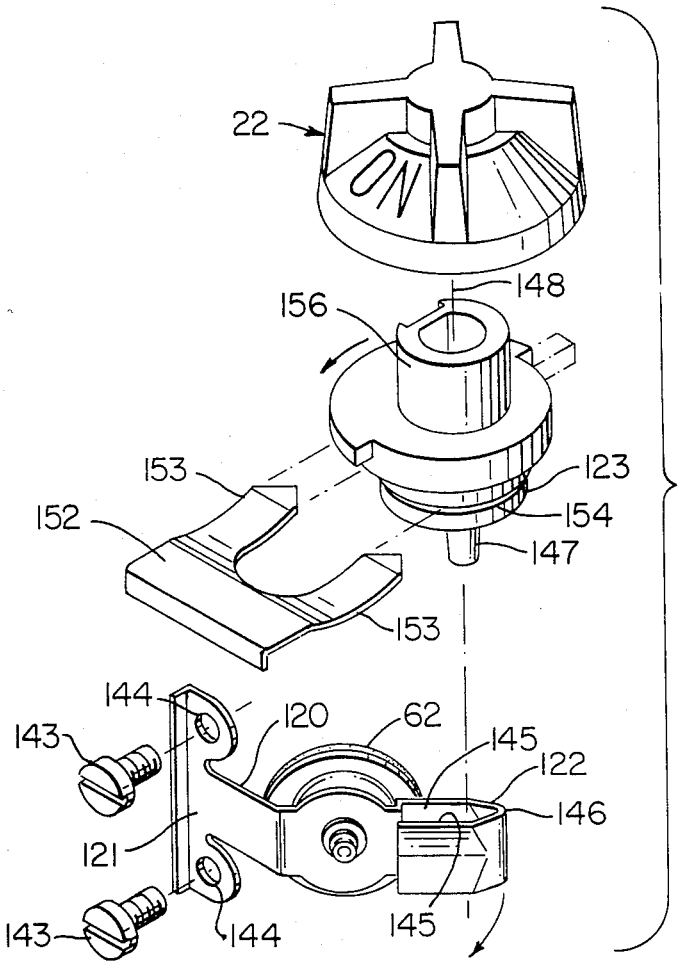
FIG. 15 is an exploded perspective view of certain parts of the valve unit of the fuel control valve construction illustrated in FIG. 12.

The end 122 of the leaf member 120 is looped upon itself to define a pair of facing surfaces 145 joined together by an arcuate portion 146 so that the end 122 is substantially U-shaped and is adapted to receive a rod-like part 147 of the cam means 123 of the control knob means 22 therebetween, the rod-like member 147 having its longitudinal axis offset relative to the axis of rotation of the cam means 123 which is indicated by the reference numeral 148 in FIG. 15 while being parallel thereto so that rotation of the cam 123 relative to the housing means 21 will cause the rod-like member 147 to act on the surface means 145 of the end 122 of the leaf member 120 to move the valve member 62 relative to the valve seat 61 as previously set forth.

The valve member 62 comprises a movable valve member carried on the leaf member 120 in the manner similar to the movable valve member 65 for the valve unit 66 previously described.

Figure 13:
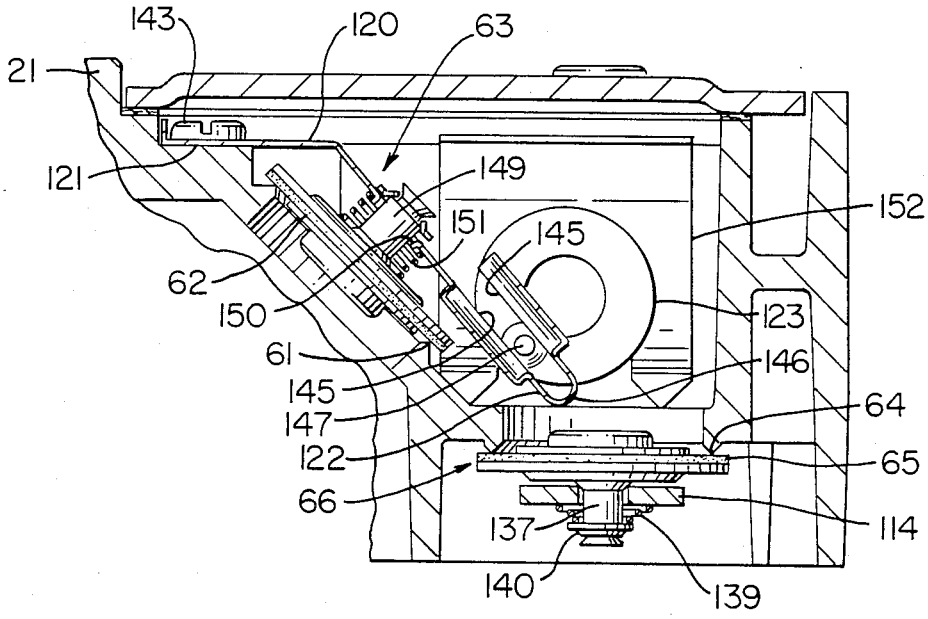
FIG. 13 is a fragmentary cross-sectional view taken on line 13—13 of FIG. 12.
Figure 14:
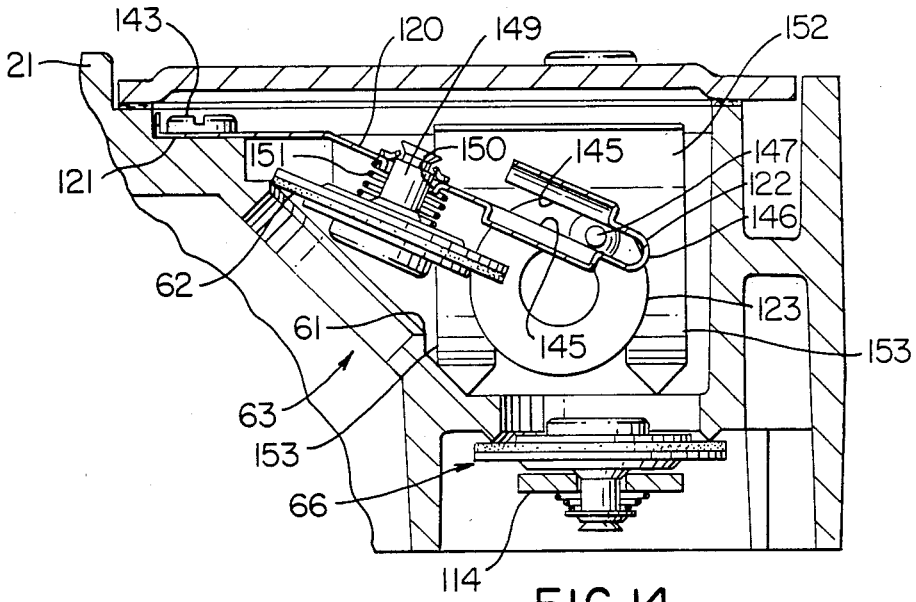
FIG. 14 is a view similar to FIG. 13 and illustrates the valve unit of the fuel control valve construction in another operating condition thereof.

In particular, the valve member 62 has a stem 149 projecting through an opening 150 in the leaf member 120 and has a compression spring 151 disposed between the leaf member 120 and the valve member 62 to permit the same to move relative to the leaf member 120 in order to assure for the full seating of the valve member 62 against the valve seat 61 when the control knob 22 is disposed in the "off" condition thereof as illustrated in FIG. 13. However, rotation of the control knob 22 to its "on" position as illustrated in FIG. 14 causes the cam rod 147 to move the leaf member 120 in opposition to the normal bias thereof to an open position so that the valve member 62 opens the valve seat 61 and maintains the same in the open condition as illustrated in FIG. 14 as long as the control knob 22 is disposed in its "on" condition.

A suitable U-shaped spring clip 152, FIGS. 15 and 19, has its legs 153 received in an annular groove 154 in the cam means 123 to rotatably mount the cam means 123 in an opening 155 in the housing means 21 as illustrated, the cam means 123 having a D-shaped post 156 for interconnecting to the control knob 22 in a manner well known in the art.

Therefore, it can be seen that the valve unit 63 provides an unique arrangement for providing control of the valve seat 61 of the control device 20 for the reasons previously set forth and can be utilized in valve constructions other than the valve construction 20 previously described, if desired.

Other details of the control device 20 are fully illustrated in the drawings and need not be further described as the particular arrangement of such structure in the control device 20, while being schematically illustrated in FIG. 19, can be readily determined by referring to the various figures of the drawings, such as FIG. 3, whereby further discussion of the details of the control device 20 of this invention is deemed unnecessary as the operation thereof and the various parts thereof have been previously set forth.

Therefore, it can be seen that this invention not only provides a new fuel control valve construction and method of making the same, but also this invention provides new parts for such a fuel control valve construction or the like and methods of making such new parts.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a valve construction having a valve unit comprising a valve seat, a movable valve member for opening and closing said valve seat, a one-piece leaf spring member carrying said valve member and having opposed ends one of which is fixed to said construction, and a rotatable actuator having cam means operating on said leaf spring member to position said leaf spring member relative to said valve seat in relation to the rotatable position of said cam means, the improvement wherein the other end of said leaf spring member is looped in a direction that is toward said one end thereof and that is substantially parallel to the longitudinal axis of said leaf spring member to define a pair of spaced apart substantially parallel elongated surface means joined together by an arcuate portion whereby said other end is substantially U-shaped, said cam means having an abutment means received between said surface means to act on said surface means of said leaf spring member to position said leaf spring member relative to said valve seat.

2. A valve construction as set forth in claim 1 wherein said actuator means has an axis of rotation, said abutment means of said actuator means being offset relative to said axis of rotation thereof.

3. A valve construction as set forth in claim 2 wherein said abutment means comprises a rod-like part having a longitudinal axis substantially parallel to said axis of rotation of said actuator means.

4. A valve construction as set forth in claim 3 wherein said axis of said rod-like part is disposed substantially transverse to said longitudinal axis of said leaf spring member.

5. A valve construction as set forth in claim 4 wherein said valve member is carried by said leaf spring member intermediate said opposed ends thereof.

6. A valve construction as set forth in claim 5 wherein said valve member is movably carried by said leaf spring member.

7. A valve construction as set forth in claim 6 wherein a compression spring is disposed between said valve member and said leaf spring member to tend to hold said valve member in one position relative to said leaf spring member.

* * * * *